US010556724B2

(12) United States Patent
Wolfson et al.

(10) Patent No.: US 10,556,724 B2
(45) Date of Patent: Feb. 11, 2020

(54) CONTAINER

(71) Applicant: Giveler LLC, Palmetto Bay, FL (US)

(72) Inventors: Louis T. Wolfson, Palmetto Bay, FL (US); Alia M. Wolfson, Palmetto Bay, FL (US)

( * ) Notice: Subject to any disclaimer, the term of this patent is extended or adjusted under 35 U.S.C. 154(b) by 128 days.

(21) Appl. No.: 15/703,088

(22) Filed: Sep. 13, 2017

(65) Prior Publication Data

US 2018/0072460 A1 Mar. 15, 2018

Related U.S. Application Data

(63) Continuation-in-part of application No. 29/580,052, filed on Oct. 5, 2016, now Pat. No. Des. 816,514.

(60) Provisional application No. 62/394,877, filed on Sep. 15, 2016.

(51) Int. Cl.

| | |
|---|---|
| ***B65D 25/04*** | (2006.01) |
| ***B65D 47/06*** | (2006.01) |
| ***B65D 43/02*** | (2006.01) |

(52) U.S. Cl.

CPC ..... *B65D 25/04* (2013.01); *B65D 43/021* (2013.01); *B65D 47/06* (2013.01); *B65D 2231/027* (2013.01); *B65D 2543/0024* (2013.01); *B65D 2543/00092* (2013.01)

(58) Field of Classification Search

CPC ..... B65D 1/04; B65D 25/04; B65D 43/021; B65D 47/063; B65D 47/065; B65D 47/066

See application file for complete search history.

(56) References Cited

U.S. PATENT DOCUMENTS

| | | | | |
|---|---|---|---|---|
| 3,052,368 | A | 9/1962 | Atkins et al. | |
| 3,334,797 | A | 8/1967 | Latham et al. | |
| 3,526,352 | A | 9/1970 | Swett | |
| 5,143,261 | A * | 9/1992 | Drobish | B65D 81/3216 222/129 |
| 5,753,289 | A | 5/1998 | Ness | |
| 5,890,627 | A | 4/1999 | Storey | |
| 6,405,675 | B1 * | 6/2002 | Mills | A01K 7/00 119/51.5 |
| 6,472,007 | B2 | 10/2002 | Bezek et al. | |
| 6,656,514 | B1 | 12/2003 | Tubbs | |
| D495,209 | S | 8/2004 | Tranfaglia et al. | |
| 6,913,777 | B2 | 7/2005 | Rebhorn et al. | |

(Continued)

FOREIGN PATENT DOCUMENTS

WO 99/01057 A1 1/1999

*Primary Examiner* — Jeffrey R Allen

(74) *Attorney, Agent, or Firm* — Gloria Tsui-Yip, Esq.; Gottlieb, Rackman & Reisman, P.C.

(57) ABSTRACT

A container having a container element, a lid element removably joined to the container element to form a sealed storage cavity, and a bowl element that removably covers the lid element to protect it during transport. The storage cavity has an interior vertical wall dividing it into multiple storage chambers. The lid element has two openings, each sealably closed by an operable flap movable from an open position to a closed position. In an open position, the flap has a convex outer surface forming a spout for the opening. In a closed position, the flap has a concave outer surface and engages all edges of the opening to seal the opening. When in use, the bowl element can be removably stowed to the bottom of the container element or used as a serving vessel.

16 Claims, 9 Drawing Sheets

(56) References Cited

U.S. PATENT DOCUMENTS

| | | | | |
|---|---|---|---|---|
| 7,975,868 | B1 * | 7/2011 | Flies | B65D 1/24 215/12.1 |
| 8,245,870 | B2 * | 8/2012 | McKinney | A47G 19/2266 215/306 |
| 8,815,318 | B2 | 8/2014 | Zos et al. | |
| 8,864,015 | B2 | 10/2014 | Lu et al. | |
| 8,864,016 | B2 | 10/2014 | Herman | |
| 8,950,630 | B2 | 2/2015 | Jackson | |
| 2002/0162862 | A1 | 11/2002 | Chung et al. | |
| 2009/0250368 | A1 | 10/2009 | Earl et al. | |
| 2009/0261156 | A1 | 10/2009 | Abbott | |
| 2009/0308870 | A1 * | 12/2009 | Chapman | A47J 43/281 220/212 |
| 2010/0126998 | A1 | 5/2010 | Wilson et al. | |
| 2010/0314434 | A1 | 12/2010 | Herman | |
| 2016/0114937 | A1 | 4/2016 | Hylton | |
| 2016/0200474 | A1 | 7/2016 | Burden | |

* cited by examiner scale=0.918

CONTAINER

This application claims benefit of provisional patent application Ser. No. 62/394,877 filed on Sep. 15, 2016, and is a continuation-in-part of design patent application Ser. No. 29/580,052 filed on Oct. 5, 2016, which are hereby incorporated by reference.

FIELD OF THE INVENTION

The present invention is directed to an improved container. In particular, an improved container for the storage and transport of food (such as solid food items or snacks) therein and the serving of food therefrom, that is portable, durable and easily operable.

BACKGROUND OF THE INVENTION

Existing containers for food items are unsatisfactory in that they do not completely seal the food items from ingress of contaminants, do not allow the user to dispense food items directly into the mouth, are not of a size and shape as to be easily portable in a purse, bag or cup holder. Existing food containers often do not offer more than one separate compartments for storing and dispensing two or more distinct food items. Existing snack containers do not allow for portioning when dispensing and eating from the containers. Most prior art containers require the use of two hands or multiple digits to operate (i.e. to open and close the container). The present invention addresses each of these shortcomings and presents an improved solution.

SUMMARY OF THE INVENTION

The container of the present invention includes a container element, a lid element, and a bowl element. The container and lid elements are removably joined together to form a sealed storage cavity. The bowl element removably covers the lid element to protect it from coming into contact with external contaminants and serves as a serving vessel.

The container element has a generally cylindrical body with a closed bottom end and an open top end defining a storage cavity. The storage cavity may be divided into multiple storage chambers with one or more interior vertical walls.

The lid element has a substantially concave upper surface, with at least one cut-out opening for the egress of food stored in the storage cavity. Each opening is sealably closed by means of an operable flap made of a resilient/elastomeric material having a generally vesical piscis shape. One curved edge of the flap is attached to the periphery edge of the opening, with the other, distal, curved edge of the flap selectively engages the opposite edge of the opening to seal the opening. The outer surface of the flap changes from a convex curve with the opening accessible and the flap forming a spout to a concave curve with the opening sealed by the flap. The distal curved edge of the flap may overhang the opposite edge of the opening to facilitate the lifting of the flap with a finger.

The bowl element is removably attachable to the top of the container element to cover and protect the lid element during transport. When the container is in use, the bowl element may alternatively be removably attachable to the bottom of the container element or be used as a serving vessel.

BRIEF DESCRIPTION OF THE DRAWINGS

Preferred embodiments of the present invention have been chosen for purposes of illustration and description and are shown in the accompany drawings forming a part of the specification herein.

DETAILED DESCRIPTION OF THE INVENTION

Figure 1:
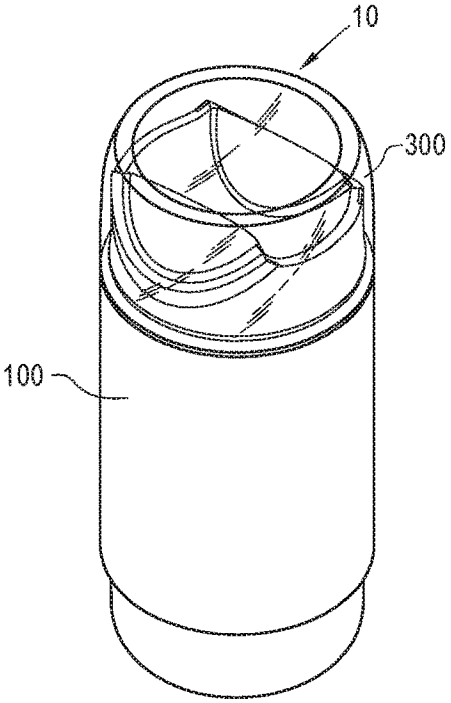
FIG. 1 is the improved container of the present invention, fully assembled in a position for travelling/transport.
Figure 2:
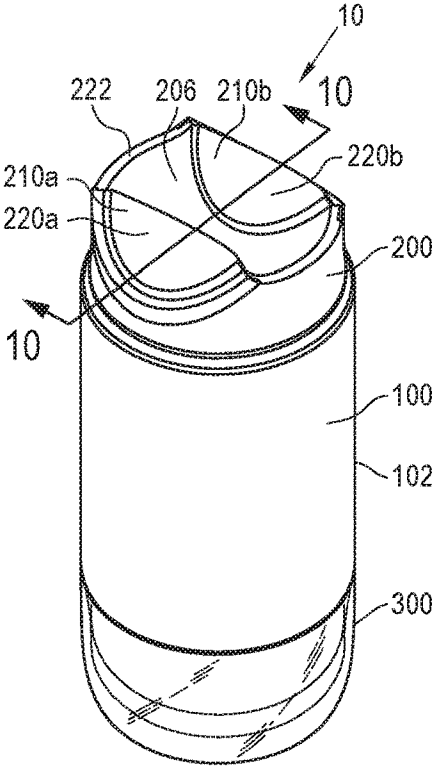
FIG. 2 is the improved container of FIG. 1, with the bowl element positioned in its alternate position to allow access to the lid element.
Figure 3:
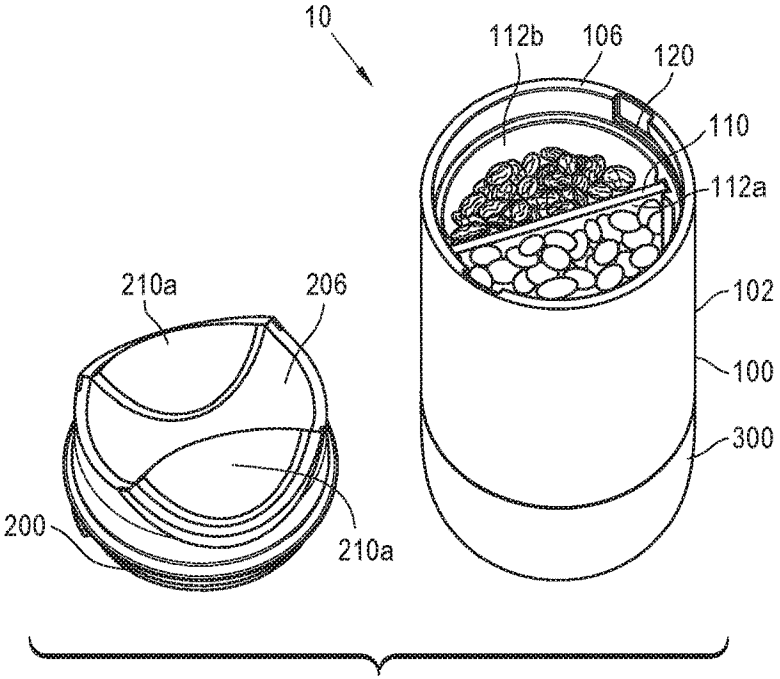
FIG. 3 is the improved container of FIG. 2 with the lid element removed from the container element to allow the filling of snacks therein.

With reference to the drawings, wherein the same reference number indicates the same element throughout, there is shown in FIGS. 1 to 17 an improved container 10 for storing, transporting and serving food or snack. The container 10 of the present invention includes a container element 100, a lid element 200, and a bowl element 300. The container element 100 and the lid element 200 are removably joined together to form a sealed storage cavity 108. The bowl element 300 removably covers the lid element 200 to protect it from coming into contact with external contaminants and serves as a serving vessel.

As shown in FIGS. 1 to 17, the container element 100 has a generally cylindrical body 102 with a closed bottom end 104 and an open top end 106 defining a storage cavity 108. Optionally, the container element 100 includes an interior vertical wall 110 to create a plurality of separate storage chambers 112*a* & 112*b* within the container element 100. Each storage chamber 112*a* & 112*b* can be filled with a different food item. The wall 110 is removably placed and positioned in the storage cavity 108 to allow a user to customize the container element 100. The wall 10 slides vertically into the container element 100, with the inner wall 114 of the container element 100 having one or more guiding channels 116 or tabs to receive the vertical wall 110. The wall 110 is not limited to a planar wall as shown in the FIGS., but can have a bent/angle/curve to the wall 110, such as one that can divide the storage cavity 108 into three or more storage chambers 112*a*, 112*b*, etc. of equal or non-equal sizes, with corresponding channels 116 for receiving different shape walls 110. The container element 100 may also include more than one interior vertical wall 110 with corresponding channels 116 for receiving the walls 110. The vertical wall 110 can alternatively be permanently fixed within the storage cavity 108.

The bottom end 104 of the container element 100 has a stepped-in cylindrical body 102 having a smaller outer diameter than the rest of the container element 100 to receive the bowl element 300. The bottom end 104 of the container element 100 and the bowl element 300 have corresponding means to releasably engage each other, such as groove 121 and tab 301, respectively. Other means for engaging the container element 100 to the bowl element 300 known to one skilled in the art, such as a helical thread, ¼ turn ramp, annular snap, friction, or via magnetic retaining element, etc. can be used.

The inner wall 114 of the container element 100 at the top end 106 has means for receiving the lid element 200, such as one or more lock turn ramps 120. Other means for engaging the lid element 200 to the container element 100 known to one skilled in the art, such as a helical thread, annular snap, friction, latch/tab and groove, or via magnetic retaining element friction, etc. can be used.

The dimensional range for the generally cylindrical body 102 can be 2.5"-2.7" for its outer diameter, so as to fit into a majority of cup holders found in vehicles, etc. However, different sizes can be used. Further, although the container element 100 is described as having a generally cylindrical body 102, other prism shapes (such as oval, any polygon, or random curve) can be used.

The container element 100 can be single- or double-walled. A double walled container element 100 with vacuum insulation provides insulative properties to maintain the temperature of the food stored therein, whether it is hot or cold. The container element 100 can be made of stainless steel or plastic, and be opaque, translucent or transparent, as illustrated in FIGS. 12-15.

The lid element 200 sealably attaches to the top end 106 of the container element 100 by means of a latch 204 at the lower end of the lid element 200 that interacts and mates with the lock turn ramp 120. The lid element 200 removably seals the storage cavity 108 of the container element 100. When the lid element 200 is removed from the container element 100, the open top end 106 of the container element 100 provides access to easily fill the storage cavity 108 or chambers 112*a* & 112*b* (see FIG. 3). The lid element 200 is made of a stiff/rigid material.

The lid element 200 has a generally concave upper surface 206, with two cut-out openings 208*a* & 208*b*. On the lower surface 207 is a depending wall 209. The depending wall 209 aligns with and abuts the wall 110 of the container element 100 when the lid element 200 is properly affixed to the container element 100. Similarly, the openings 208*a* & 208*b* correspondingly align with the separate chambers 112*a* & 112*b* of the container element 100 when the lid element 200 is properly affixed to the container element 100. As such, a user can selectively dispense from the chambers 112*a* & 112*b* through the corresponding opening 208*a* & 208*b*. Due to the restricted aperture size of the openings 208*a* & 208*b*, the lid element 200 dispenses food item from the container element 100 in a controlled manner. Food items from the container element 100 exits the openings 208*a* & 208*b* at a manageable rate (as opposed to uncontrolled amount of food flowing out). To the extent wall 110 is not planar and has a different shape or design, the depending wall 209 has a corresponding shape or design as wall 110 to be able to isolate the chambers 112*a*, 112*b*, etc.

The openings 208*a* & 208*b* are sealably closed by means of operable flaps 210*a* & 210*b* made of a resilient/elastomeric material such as silicone. Each flap 210*a* or 210*b* has a generally vesical piscis shape, with opposing curved edges 212*a* or 212*b* & 214*a* or 214*b*. The lower curved edge 212*a* or 212*b* of each flap 210*a* or 210*b* is permanently attached to the lid element 200 around the peripheral edge 216*a* or 216*b* of the opening 208*a* or 208*b*. The distal, upper, curved edge 214*a* or 214*b* of each flap 210*a* or 210*b* selectively engages the inner edge 218*a* or 218*b* of the opening 208*a* or 208*b*. The flap 210*a* or 210*b* is formed from a section of a cylinder, and the outer surface 220*a* or 220*b* of the flap 210*a* or 210*b* changes from a convex curve with the opening 208*a* or 208*b* accessible (see FIGS. 6 and 10) to a concave curve with the opening 208*a* or 208*b* sealed by the flap 210*a* or 210*b* (see FIG. 2). The distal, upper, curved edge 214*a* or 214*b* of the flap 210*a* or 210*b* overhangs the inner edge 218*a* or 218*b* of the opening adjacent the concave upper surface 206 to facilitate the lifting of the flap 210*a* or 210*b* with a finger. Each flap 210*a* or 210*b* is movable from a closed position by grasping anywhere along the distal, upper, curved edge 214*a* or 214*b* of the flap 210*a* or 210*b* with the tip of a finger, and pulling it outwards and away from the inner edge 218*a* or 218*b* of the opening 208*a* or 208*b* and the central axis of the container element 100. The distal, upper, curved edge 214*a* or 214*b* of the flap 210*a* or 210*b* and the inner edge 218*a* or 218*b* of the opening 208*a* or 208*b* further restrict the aperture size of the openings 208*a* & 208*b* for controlled dispensing of food from the chambers 112*a* or 112*b*. The outer surface 220*a* or 220*b* of the flap 210*a* or 210*b* in a convex curve state forms a spout for the guided dispensing of food from the chambers 112*a* or 112*b*, and provides a visual view of the food being dispensed (see FIG. 5). The spout also allows a user to pour food items directly into one's mouth due to the controlled dispensing from the restricted aperture size of the openings 208*a* & 208*b*, which is convenient for a driver of a vehicle.

To close the opening 208*a* or 208*b*, the outer surface 220*a* or 220*b* or distal upper edge 214*a* or 214*b* of the flap 210*a* or 210*b* is pushed inwards and towards the inner edge 218*a* or 218*b* or the opening 208*a* or 208*b* with the tip of a finger. In a closed position, the flap 210*a* or 210*b* rests and presses against the inner edge 218*a* or 218*b* of the opening 208*a* or 208*b* creating a substantial seal against the ingress of contaminants or the egress of food stored in the chamber 112*a* or 112*b*. The flap 210*a* or 210*b* securely rests against the opening 208*a* or 208*b* due to the interaction between the resiliency of the flap 210*a* or 210*b* against the stiff/rigid structure of opening 208*a* or 208*b* of the lid element 200. The flap 210*a* or 210*b* requires no additional retention features such as snap teeth to keep the flap in a closed position, nor the open position. The flap 210*a* or 210*b* naturally stays at rest in each of the two positions, open or closed. The flap 210*a* or 210*b* is easily operated with one finger, to both close and open. This feature is particularly helpful for a driver of a vehicle.

Due to the positioning of the distal curved edge 214*a* or 214*b* of the flap 210*a* or 210*b* being near the central axis and adjacent the concave curved surface 206 of the lid element 200 below the top edge 222 of the lid element 200, accidental lifting (i.e. opening) of the flap 210*a* or 210*b* is avoided.

Bowl element 300 has a substantially flat base 302 with a generally cylindrical wall 304 extending from the base 302 defining a hollow area 306. The bowl element 300 removably attaches to the lid element 200 or the container element 100. To protect the lid element 200 during transport and to prevent contaminants from contacting the lid element 200 as an additional barrier to ingress of contaminants into the container element 100, the bowl element 300 is attachable to the lid element 200 with the rim 308 of the cylindrical wall 304 engaging a flange 224 of the lid element 200. The lid element 200 is substantially entirely fit within the hollow area 306 of the bowl element 300. Positioning the bowl element 300 over the lid element 200 also prevents the accidental egress of food items from the container element 100. In the hollow area 306 not taken up by the lid element 200, e.g. above the closed flaps 210*a* & 210*b* (see FIGS. 1 & 2), is a diametrically aligned space (see line 10-10 in FIG. 2) that can be used to store appropriately sized accessories such as a foldable utensil, a towelette, etc.

Figure 5:
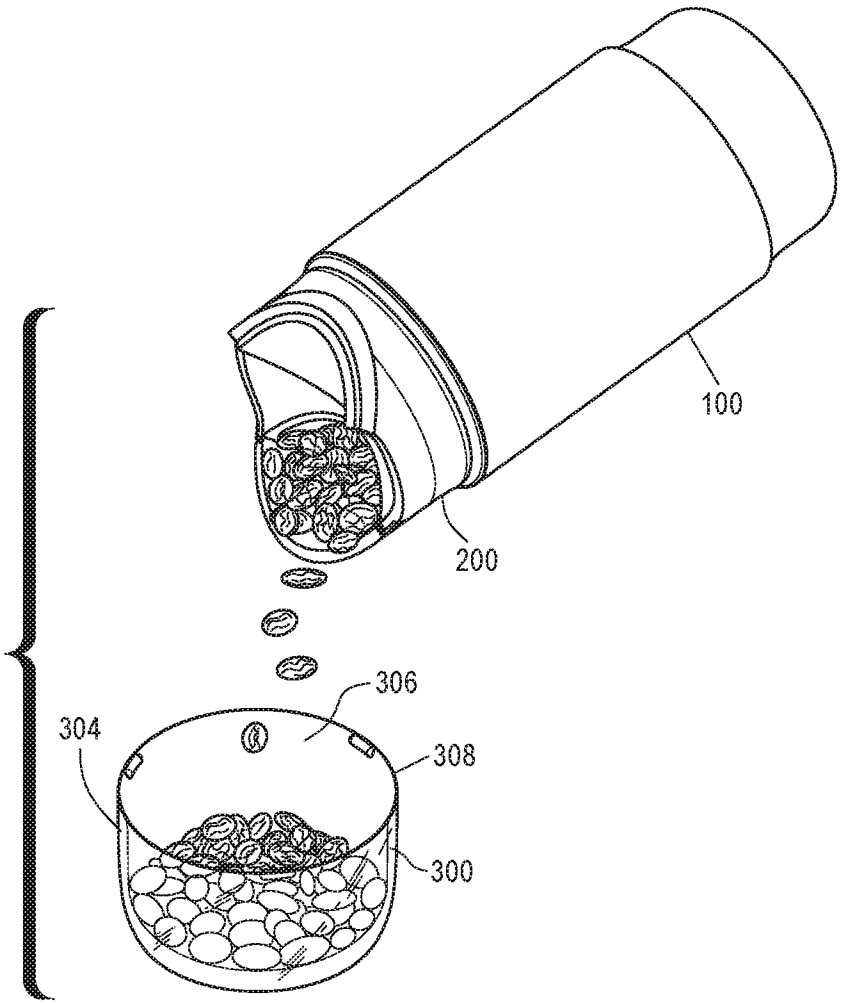
FIG. 5 is the improved container of FIG. 4, with the bowl element disassembled from the container element and in use as a serving vessel.

The bowl element 300, after removal from the lid element 200 can be used as a serving vessel to hold a portion of the food items dispensed from the container element 100 so that the food items are easily accessible by the user's fingers to grasp and eat the food items (see FIG. 5). If the bowl element 300 is not used as a serving vessel, it may alternatively be attached to the bottom end 104 of the container element 100 as described above (see FIGS. 2, 4, 8, etc.). With the bowl element 300 placed on the bottom end 104 of the container element 100, it is out of the way so it does not hinder access to the operable flaps 210*a* & 210*b*, but stays connected to the container element 100 so there are no loose parts to lose in use or transport. The bowl element 300 can be conveniently stowed away in a way that it stays clean for later use.

Figure 16:
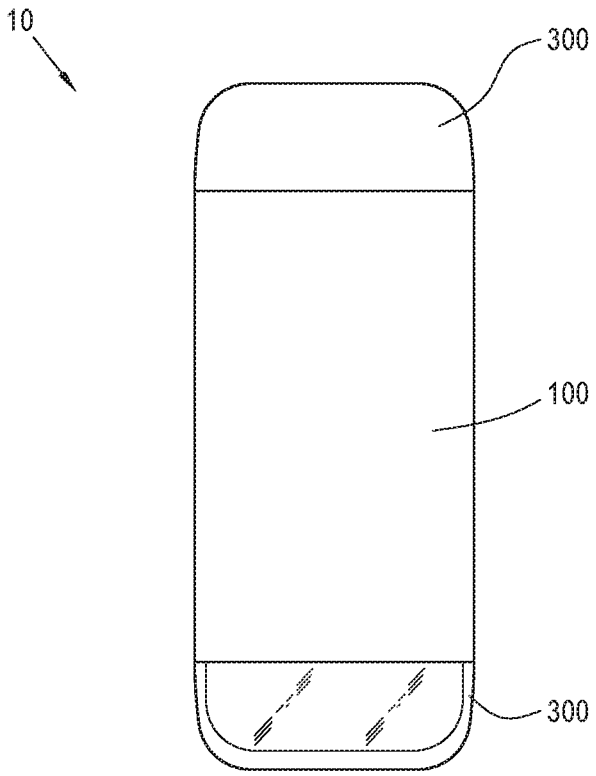
FIG. 16 is the improved container of the present invention with two bowl elements.

One or two bowl elements 300 can be used with a container element 100 and a lid element 200. If one bowl element 300 is used, it can be conveniently stored/carried either at the bottom end 104 of the container element 100 or on top of and over the lid element 200. For example, the bowl element 300 can be stowed on the bottom end 104 when in a car, so that the user can easily access the flaps 210*a* & 210*b* to access the food contained in the container element 100; and when in a bag, the bowl element 300 can be stowed on top of and over the lid element 200 to prevent contaminants from reaching the lid element 200 or entering the container element 100. As shown in FIG. 16, if two bowl elements 300 are used, then one can be stored/carried at the bottom end 104 of the container element 100 and the other can be stored/carried on top of and over the lid element 200. Having two bowl elements 300 allows two different food items from the two chambers 112*a* & 112*b* to be dispensed from the container element 100 and served in two separate bowl elements 300 for convenient snacking/sharing.

Figure 4:
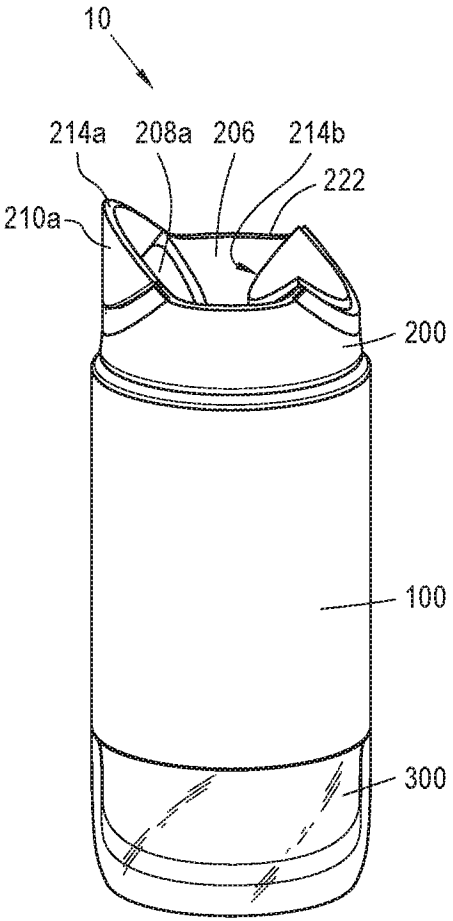
FIG. 4 is the improved container of FIG. 2 with one of the two flaps on the lid element in an open position.
Figure 8:
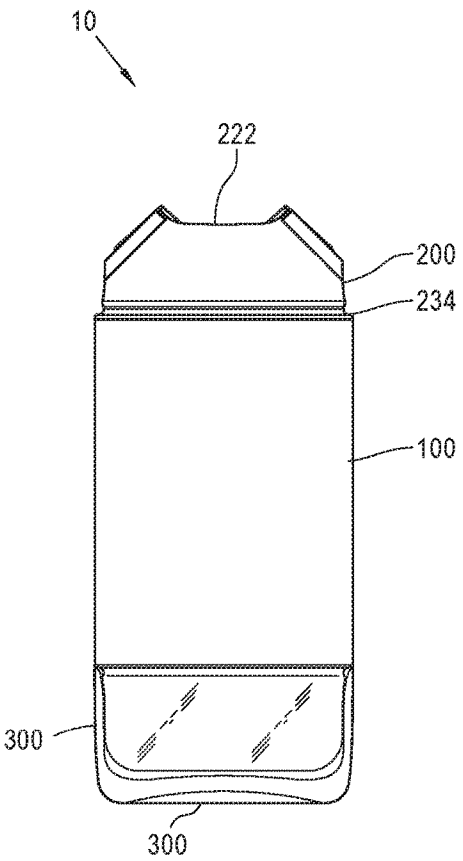
FIG. 8 is another view of FIG. 2.
Figure 7:
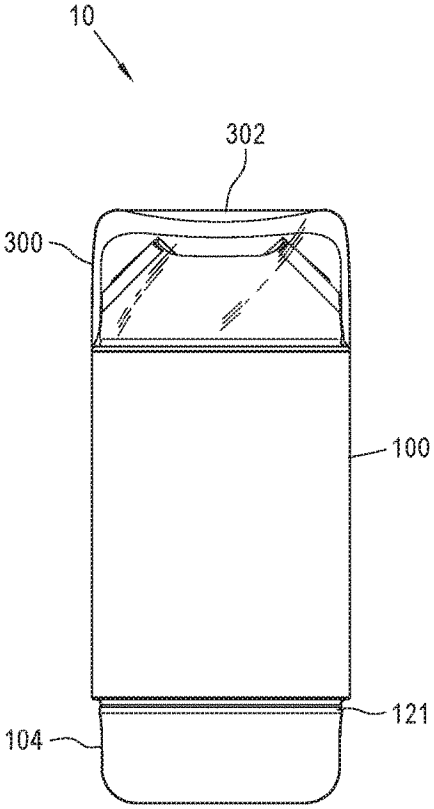
FIG. 7 is another view of FIG. 1.
Figure 6:
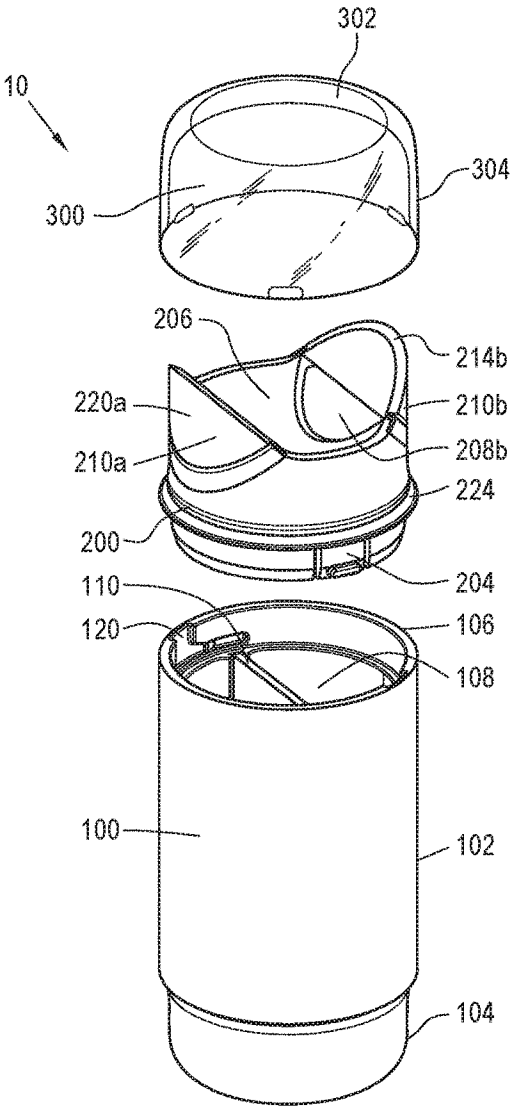
FIG. 6 is an exploded view of the improved container of the present invention.
Figure 9:
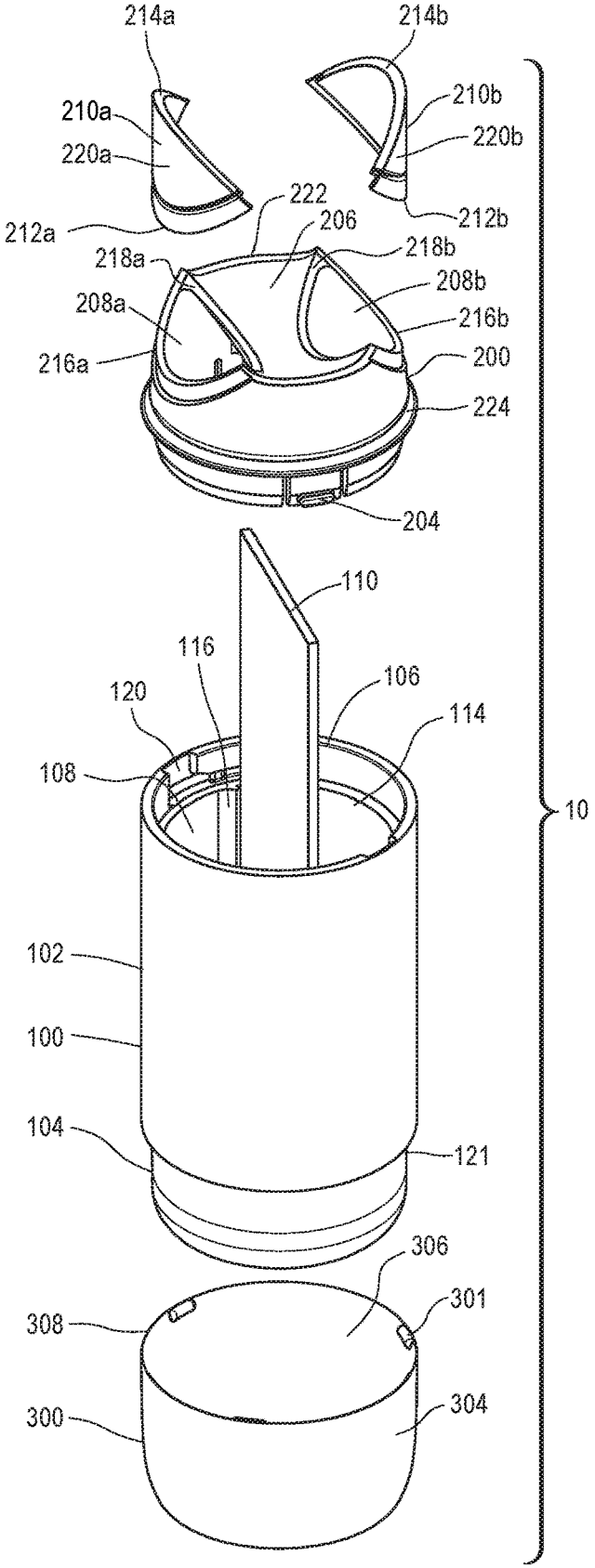
FIG. 9 is another exploded view of the improved container of the present invention.
Figure 10:
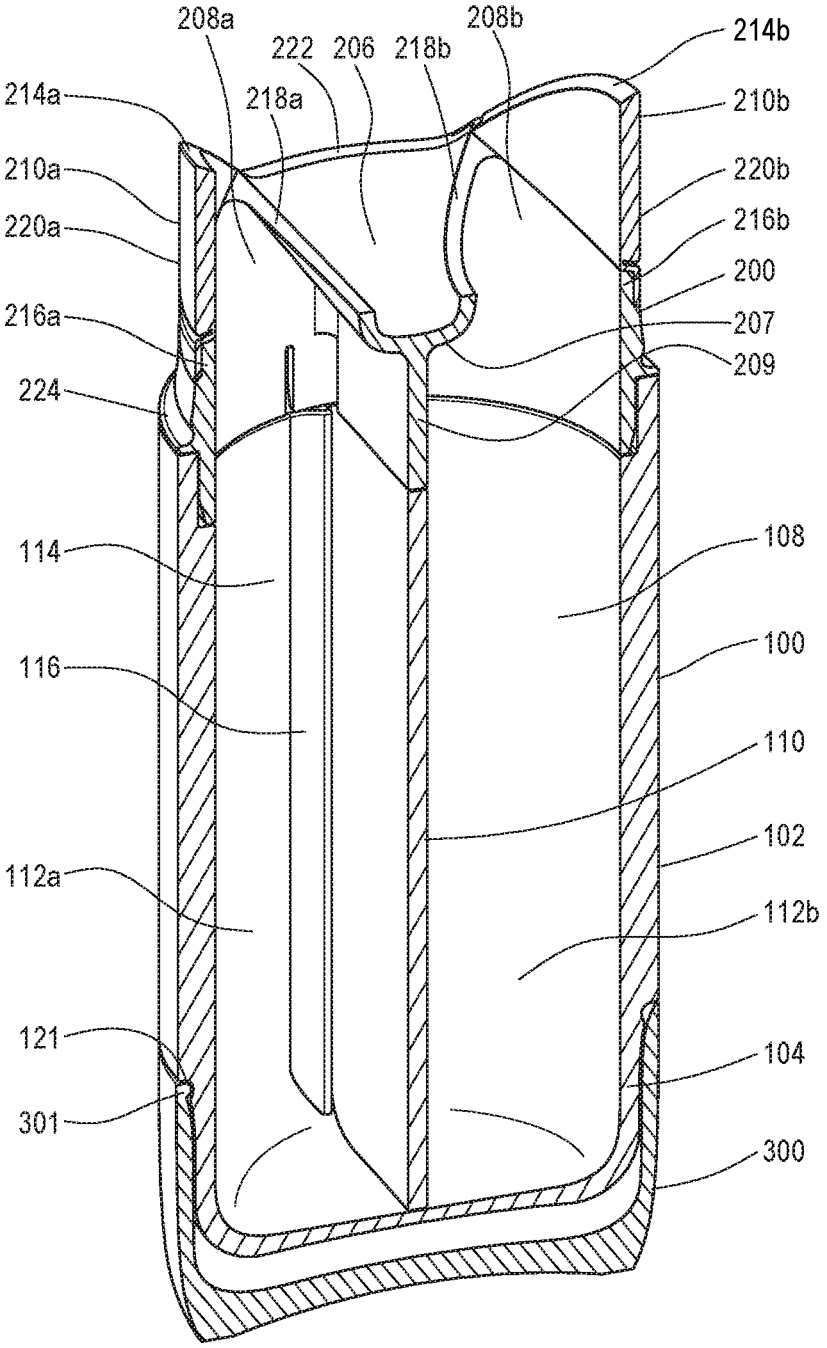
FIG. 10 is a cross-sectional view taking along line 10-10 of FIG. 2 with the two flaps on the lid element in an open position.
Figure 11:
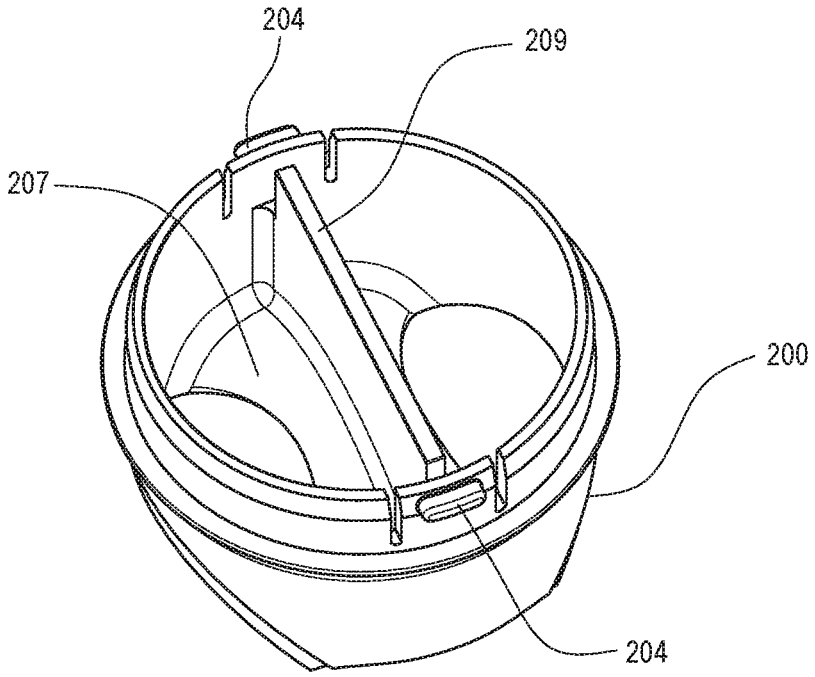
FIG. 11 is a bottom perspective view of the lid element with both flaps in closed position.
Figure 15:
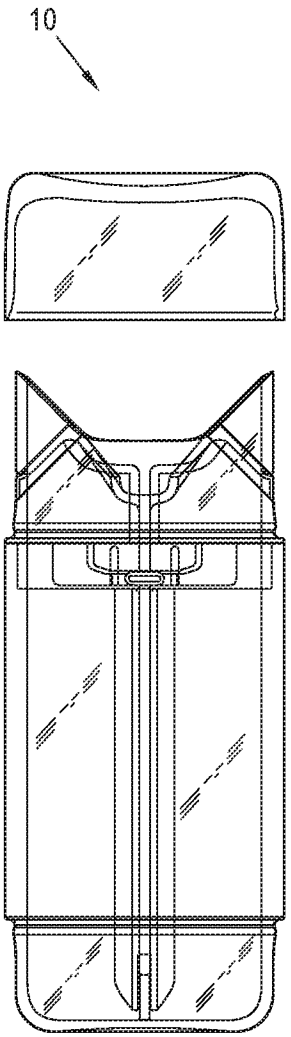
FIGS. 12 to 15 illustrate different color, material, and finish of the improved container of the present invention.
Figure 14:
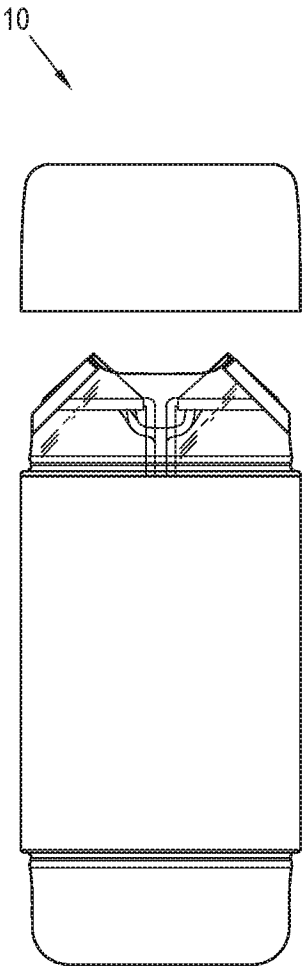
Figure 13:
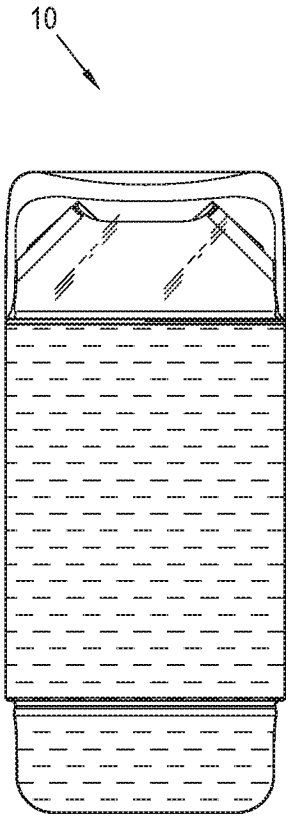
Figure 12:
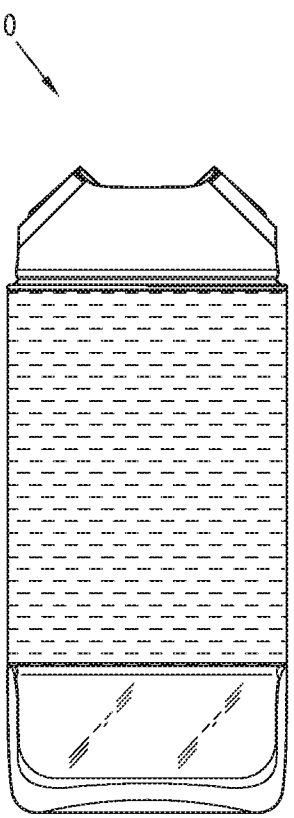

When the bowl element 300 is stowed on the bottom end 104 of the container element 100, it can fit over the stepped-in cylindrical body 102 such that the profile of the container element 100 is streamlined (see FIGS. 4, 8 and 10). Similarly, when the bowl element 300 is stowed on the top of and over the lid element 200, the profile of the container element 100 is also streamlined (see FIGS. 1 and 7).

Figure 17:
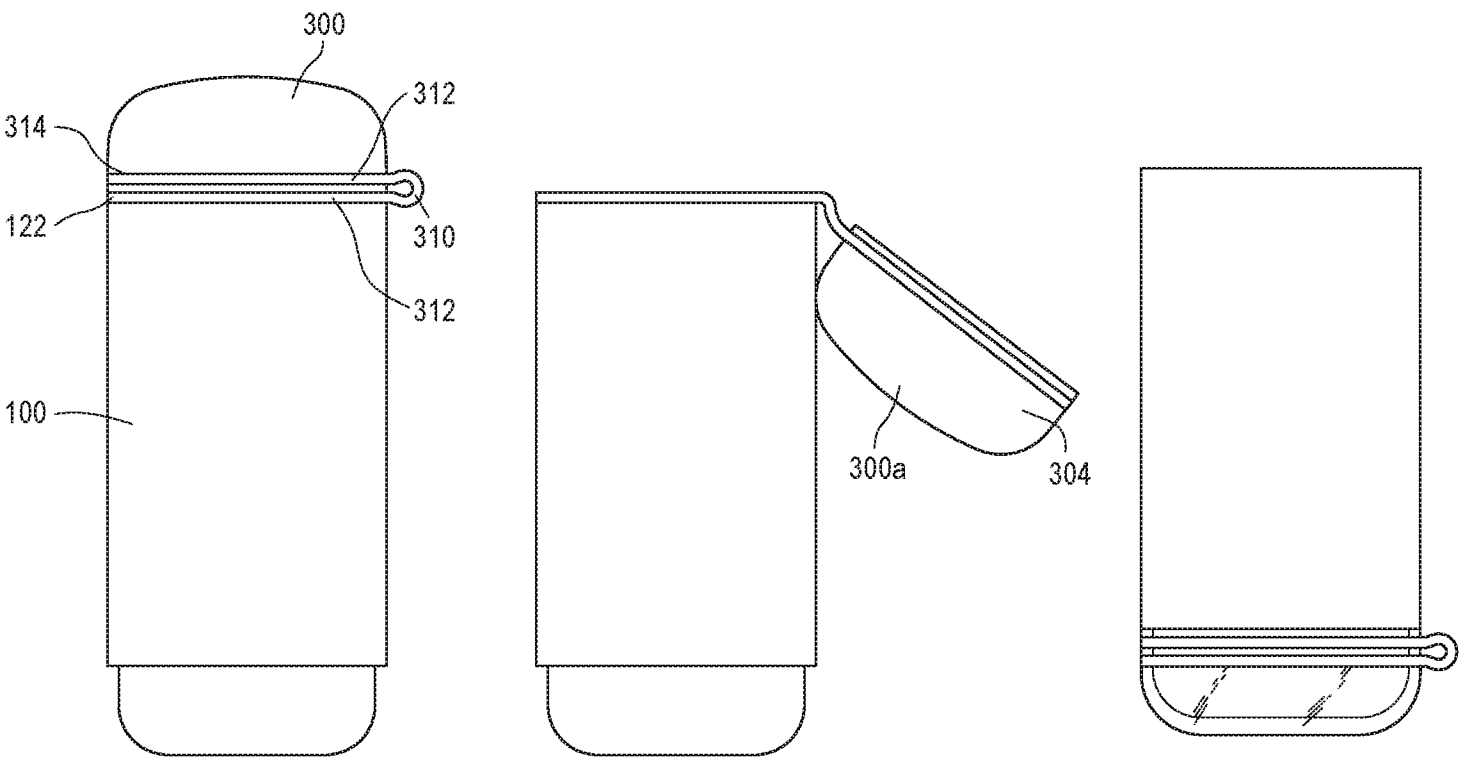
FIG. 17 is a simplified view (without showing the lid element) of the improved container illustrating a tethered bowl element in various positions.

FIG. 17 shows another embodiment where the bowl element 300*a* is releasably tethered to the top end 106 of the container element 100 by means of a flexible/elastomeric tether element 310 having a length of material connecting two interconnected loops 312. The two loops 312 engage an annular groove 314 on the cylindrical wall 304 of bowl element 300*a* and an annular groove 122 adjacent the top end 106 of the container element 100, respectively. The loops 312 may be stretched to fit into the grooves 314 & 122 or they may be frictionally held to be easily releaseable from the bowl element 300*a* or the container element 100. The bowl element 300*a* may alternatively be tethered to groove 121 with the bowl element 300*a* placed on the bottom end 104 of the container element 100.

FIGS. 12 to 15 show that the container element 100, lid element 200 and bowl element 300 can be made of different color, material, and finish, such as plastic, glass, stainless steel, shiny, matte, transparent, translucent, opaque, etc.

The features of the invention illustrated and described herein are the preferred embodiments. Therefore, it is understood that the specification is intended to cover unforeseeable embodiments with insubstantial differences that are within the spirit of the specification.

What we claim is:

1. A container for storing, transporting, and serving food items, comprising:

a container element having a generally cylindrical body having a central axis, with a closed bottom and an open top defining a storage cavity for storing the food items;

a lid element made of a rigid material removably joined to said container element to seal said storage cavity, said lid element has a generally cylindrical side wall and a substantially concave upper surface with at least one opening for the egress of the food items and at least one flap made of a resilient material for selectively sealing said corresponding opening movable from an open position to a closed position;

wherein each of said at least one opening has a periphery edge along said side wall of said lid element and an opposite edge along said concave upper surface of said lid element adjacent said central axis;

wherein each of said at least one flap has an outer surface, a lower curved edge attached to said periphery edge of said opening and an upper curved edge that selectively engages said opposite edge of said opening to selectively seal said opening in said closed position;

wherein when said flap is in said open position, said outer surface of said flap has a convex curve that is continuous with said cylindrical side wall of said lid element forming a spout for said opening for smooth egressing of food items from said container element and when said flap is in said closed position, said outer surface of said flap has a concave curve; and at least one bowl element that removably covers said lid element in a first position.

2. The container of claim 1 wherein said flap has a generally vesical piscis shape.

3. The container of claim 1 wherein said container element further comprises at least one interior vertical wall dividing said storage cavity into two or more storage chambers.

4. The container of claim 3 wherein said at least one interior vertical wall is removably insertable into said storage cavity.

5. The container of claim 3 wherein said container element has an inner wall with means for slidably receiving and positioning said at least one interior vertical wall in said storage cavity.

6. The container of claim 1 wherein said container element has means for removably joining said lid element to said container element.

7. The container of claim 1 wherein said upper curved edge of said flap overhangs said opposite edge of said opening in said closed position to facilitate moving said flap to said open position.

8. The container of claim 1 wherein said lid element has a top edge and said opposite edge of said opening is below said top edge on said substantially concave upper surface.

9. The container of claim 1 wherein said bowl element is removably attached to said closed bottom of said container element in a second position.

10. The container of claim 1 wherein said bowl element is removed from said lid element and serves as a serving vessel of said food items egressed from said container in a third position.

11. The container of claim 10 wherein said closed bottom of said container element has a smaller diameter than a diameter of said open top of said container element such that said container element and said bowl element has a smooth streamline profile at the junction where said bowl element meets said container element.

12. The container of claim 1 wherein said bowl element and said closed bottom of said container element have corresponding means to releasably attach to each other.

13. The container of claim 12 wherein said means for releasably attachment comprises a length of material connecting two interconnected loops, with each loop removably attachable to said bowl element and said container element respectively.

14. The container of claim 1 wherein said bowl element has a substantially flat base with a generally cylindrical wall extending from said base defining a hollow area that substantially encloses said lid element in said first position.

15. The container of claim 1 wherein having first and second bowl elements, with said first bowl element in said first position and said second bowl element in a second position removably attached to said closed bottom of said container element.

16. A container for storing, transporting, and serving food items, comprising:

a container element having a generally cylindrical body having a central axis, with a closed bottom and an open top defining a storage cavity for storing the food items, and an interior vertical wall dividing said storage cavity into two storage chambers;

a lid element made of a rigid material removably joined to said container element to seal said storage cavity, said lid element has a generally cylindrical side wall and a substantially concave upper surface with two openings for the egress of corresponding food items from each of said two storage chambers and two flaps made of a resilient material for selectively sealing said a corresponding opening movable from an open position to a closed position;

wherein each of said openings has a periphery edge along said side wall of said lid element and an opposite edge along said concave upper surface of said lid element adjacent said central axis;

wherein each of said flaps has an outer surface, a lower curved edge attached to said periphery edge of said corresponding opening and an upper curved edge that selectively engages said opposite edge of said corresponding opening to selectively seal said corresponding opening in said closed position;

wherein when said flap is in said open position, said outer surface of said flap has a convex curve that is continuous with said cylindrical side wall of said lid element forming a spout for said corresponding opening for smooth egressing of food items from said respective storage chamber and when said flap is in said closed position, said outer surface of said flap has a concave curve; and at least one bowl element that removably covers said lid element in a first position.

* * * * *